United States Patent [19]

Pitzi

[11] Patent Number: 5,012,778

[45] Date of Patent: May 7, 1991

[54] EXTERNALLY DRIVEN COMPRESSION RELEASE RETARDER

[75] Inventor: Vincent J. Pitzi, South Windsor, Conn.

[73] Assignee: Jacobs Brake Technology Corporation, Wilmington, Del.

[21] Appl. No.: 585,954

[22] Filed: Sep. 21, 1990

[51] Int. Cl.[5] ..... F02D 13/04

[52] U.S. Cl. ..... 123/321; 123/90.16

[58] Field of Search ..... 123/90.12, 90.13, 90.16, 123/320, 321, 347, 348

[56] References Cited

U.S. PATENT DOCUMENTS

| | | | |
|---|---|---|---|
| Re. 33,052 | 9/1989 | Meistrick et al. | 123/321 |
| 3,220,392 | 11/1965 | Cummins | 123/321 |
| 3,405,699 | 10/1968 | Laas | 123/320 |
| 4,271,796 | 6/1981 | Sickler et al. | 123/321 |
| 4,395,884 | 8/1983 | Price | 60/602 |
| 4,398,510 | 8/1983 | Custer | 123/321 X |
| 4,399,787 | 8/1983 | Cavanagh | 123/321 |
| 4,473,047 | 9/1984 | Jakuba et al. | 123/323 |
| 4,510,900 | 4/1985 | Quenneville | 123/321 |
| 4,572,114 | 2/1986 | Sickler | 123/21 |
| 4,592,319 | 6/1986 | Meistrick | 123/321 |
| 4,664,070 | 5/1987 | Meistrick et al. | 123/321 X |
| 4,706,624 | 11/1987 | Meistrick et al. | 123/321 |
| 4,793,307 | 12/1988 | Quenneville et al. | 123/323 |
| 4,936,273 | 6/1990 | Myers | 123/321 |

*Primary Examiner*—Willis R. Wolfe

*Attorney, Agent, or Firm*—Robert R. Jackson

[57] ABSTRACT

An engine retarding system of a gas compression release type is provided for an engine equipped with a high pressure hydraulic fluid supply system. The retarder comprises an hydraulically driven exhaust valve actuator, a solenoid actuated servo valve controlling the flow of high pressure hydraulic fluid from the supply to the actuator and an electronic controller which provides a signal to operate the solenoid as a function of the engine speed and crankshaft position.

10 Claims, 7 Drawing Sheets

EXTERNALLY DRIVEN COMPRESSION RELEASE RETARDER

BACKGROUND OF THE INVENTION

1. Field of the Invention

The present invention relates to engine retarders of the compression release type. More particularly it relates to an improved retarder driven from a source of high pressure hydraulic fluid and triggered electronically.

2. The Prior Art

Engine retarders of the compression release type are well known in the art. In general, such retarders are designed temporarily to convert an internal combustion engine into an air compressor so as to develop a retarding horsepower which may be a substantial portion of the operating horsepower developed by the engine in its operating mode.

The basic design for an engine retarding system of the type here involved is disclosed in the Cummins U.S. Pat. No. 3,220,392. In that design an hydraulic system is employed wherein the motion of a master piston actuated by an appropriate intake, exhaust or fuel injector pushtube or rocker arm controls the motion of a slave piston which opens the exhaust valve of the internal combustion engine near the end of the compression stroke whereby the work done in compressing the intake air is not recovered during the expansion or "power" stroke but, instead, is dissipated through the exhaust and cooling systems of the engine.

A number of improvements have been made with respect to the original design shown in the Cummins U.S. Pat. No. 3,220,392. Some of these improvements were directed toward increasing the retarding horsepower developed by the mechanism while others were designed to protect components of the engine from damage.

Laas U.S. Pat. No. 3,405,699 discloses a device to unload the hydraulic system whenever excess motion of the slave piston tends to open the exhaust valve too far and hence risk damage as a result of the engine piston striking the opened exhaust valve.

Sickler et al. U.S. Pat. No. 4,271,796 discloses a pressure relief system for a compression release engine retarder wherein a bi-stable ball relief valve and damping mechanism rapidly drops the pressure in the high pressure hydraulic system to a predetermined low level whenever an excess pressure is sensed in the hydraulic system thereby obviating the risk of damage to various components of the engine valve train mechanism, particularly the pushtubes used to drive the retarder.

Price U.S. Pat. No. 4,395,884 discloses a mechanism for increasing the retarding power of a compression release retarder by increasing the flow of air through the engine during retarding. This is accomplished by diverting the exhaust to one side of the twin entry turbocharger to increase the speed of the turbocharger.

Custer U.S. Pat. No. 4,398,510 discloses an improved timing mechanism for an engine retarder which produces an increased retarding horsepower while increasing the time span between the beginning of the engine retarding action and the beginning of the normal opening of the exhaust valves of the engine.

Jakuba et al. U.S. Pat. No. 4,473,047 discloses a compression release engine retarder for an engine having dual exhaust valves wherein, during the retarding mode, only one of the dual exhaust valves is opened while in the powering mode both valves are opened.

Cavanagh U.S. Pat. No. 4,399,787 discloses an hydraulic reset mechanism particularly applicable to engine retarders of the type described in U.S. Pat. No. 4,473,047 wherein the exhaust valve opened during retarding is closed promptly after the retarding event has been completed and well before the normal opening of the dual exhaust valves begins thereby avoiding damage due to unbalanced or stress loading of the exhaust valve crosshead.

Quenneville U.S. Pat. No. 4,510,900 discloses a compression release retarder driven from a rotary pump which, in turn, is driven from the engine camshaft or crankshaft so as to bypass portions of the valve train mechanism, particularly the pushtubes.

Meistrick et al. U.S. Pat. No. 4,706,624 discloses a compression release engine retarder employing a high pressure plenum pumped by master pistons driven by the engine pushtubes. The retarder of U.S. Pat. No. 4,706,624 produces improved retarding performance by opening the exhaust valves more rapidly and at a more precisely controlled point.

Meistrick U.S. Pat. No. 4,592,319 discloses a compression release retarder in which two compression release events per cylinder are produced during each engine cycle thereby increasing the retarding horsepower developed by the engine.

Quenneville et al. U.S. Pat. No. 4,793,307 discloses an articulated rocker arm assembly for use in connection with a pushtube driven compression release retarder capable of producing two compression release events per cylinder per engine cycle. The articulated rocker arm disables the motion of the exhaust valve when the engine is in the retarding mode so as to provide for the second compression release event during each engine cycle.

In response to recent requirements that engine manufacturers reduce the emissions from the engine and increase the fuel economy, new problems have been presented affecting the engine retarder. Increased retarding power is desirable but this implies increased pushtube loading. At the same time, the clearance between the exhaust valve and the engine piston has been reduced so that the maximum opening of the exhaust valve during the compression release event is restricted. Certain of the new engines are being designed with a smaller displacement but operated at a higher speed to attain the desired operating horsepower. While increased engine speed improves the retarder performance, the time during which the retarding event is accomplished is shortened so that more precise timing and more rapid motion of the mechanism is required. Some of the new engines are being equipped with a high pressure hydraulic fluid system intended, among other things, for the operation of the fuel injectors. Such engines, not having fuel injector pushtubes, cannot be fitted with compression release retarders designed to be driven by the fuel injector pushtubes, but instead would require alternate designs such as that shown in Meistrick et al. U.S. Pat. No. Re. 33,052 and Meistrick et al. U.S. Pat. No. 4,706,624. The present invention is directed to an improved and simplified compression release retarder driven from a high pressure hydraulic fluid source rather than the engine pushtubes and designed for high performance and high speed operation to meet the needs of a new generation of engines.

SUMMARY OF THE INVENTION

In accordance with the present invention applicant has provided an improved compression release retarder for an internal combustion engine having a high pressure hydraulic fluid supply and regulator incorporated therein. The retarder comprises, for each engine cylinder, a high speed solenoid actuated servo valve and an exhaust valve actuator. An electronic controller together with the usual electrical control circuit is provided to actuate the several servo valves. This system produces one compression release event per cylinder per engine cycle. If additional means are provided to disable the normal actuation of the exhaust valves and modify the actuation of the intake valves, the system may be operated to produce two compression release events per cylinder per engine cycle.

Additional advantages of the apparatus in accordance with the present invention will become apparent from the following detailed description of the invention and the accompanying drawings in which.

DETAILED DESCRIPTION OF THE INVENTION

Figure 1:
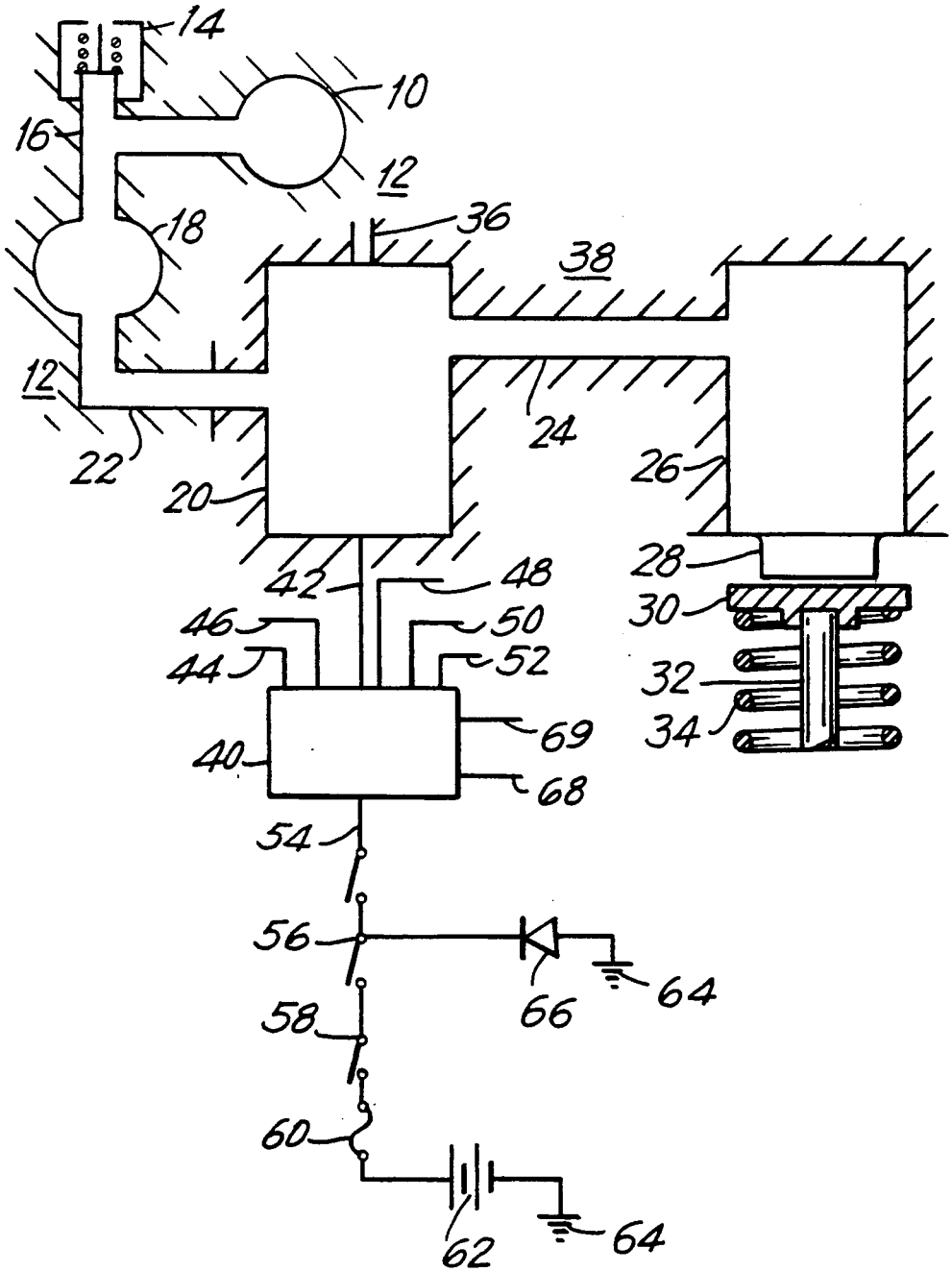
FIG. 1 is a schematic diagram of a compression release engine retarder incorporating an electronically controlled servo valve and exhaust valve actuator in accordance with the present invention.

FIG. 1 is a schematic diagram of a compression release engine retarder in accordance with the present invention. A high pressure hydraulic pump 10 of known design is incorporated in or attached to an internal combustion engine 12. The pump 10 is typically a wobble plate or swash plate pump of known design driven, for example, from the engine crankshaft or cam shaft and is capable of producing a continuous flow of at least about 5 gallons per minute at a regulated pressure on the order of 3000 psi. The desired operating pressure is controlled by a regulator 14 of known design which communicates with the pump 10 through a duct 16. Excess hydraulic fluid, typically engine oil, may be bled from the regulator 14 and returned to the appropriate sump (not shown). The high pressure hydraulic fluid is stored in a high pressure plenum 18 which also communicates with the duct 16. The pump 10, regulator 14, duct 16 and plenum 18 constitute a high pressure hydraulic fluid supply system which normally is provided to drive the fuel injectors or other operating systems of the engine. It is separate from the low pressure engine oil lubricating system although it may be supplied from the engine oil sump.

High pressure hydraulic fluid is supplied to a solenoid actuated servo valve 20 through a duct 22. High pressure hydraulic fluid leaves the servo valve 20 through duct 24 which communicates with the exhaust valve actuator 26 which contains an actuator piston 28. The actuator piston 28 is aligned with a contact plate 30 fitted on the stem 32 of the exhaust valve which is biased toward the closed position by a valve spring 34. When the servo valve 20 is in the "off" position, hydraulic fluid drains from the actuator and duct 24 through duct 36 which communicates with the sump (not shown). The solenoid actuated servo valve 20, exhaust valve actuator 26 and duct 24 are located in a retarder housing 38 attached to the engine 12.

The solenoid of the servo valve 20 is activated by the electronic controller 40 through conduit 42. Additional conduits 44, 46, 48, 50 and 52 lead to similar solenoid controlled servo valves 20 associated with other engine cylinders. The electronic controller 40 is powered by the usual retarder control circuit comprising, in series, a manual on-off switch 54, a fuel pump switch 56, a clutch switch 58, a fuse or circuit breaker 60, the vehicle battery 62 and ground 64. A diode 66 is also connected between the fuel pump switch 56 and ground 64. The manual switch 54 permits the vehicle operator to turn off the retarder at his option. The fuel pump switch 56 automatically shuts off or reduces the flow of fuel whenever the retarder is in operation while the diode 66 prevents arcing of the switch contacts. The clutch switch 58 turns off the retarder whenever the clutch pedal is depressed to prevent stalling of the engine.

Conduit 68 provides an input to the controller 40 which is proportional to the engine crankshaft position which serves as a reference point for the timing of the signal to actuate the solenoid controlled servo valve 20. Devices for sensing the position of the crankshaft are well known in the art as noted, for example, in Sickler U.S. Pat. No. 4,572,114. It will be appreciated by those skilled in the art that the timing of the actuating signal is a function of the response time of the solenoid; the opening characteristics of the servo valve; the pressure of the hydraulic fluid; the diameter of the actuator piston; the clearance between the actuator piston and the exhaust valve stem; and the speed of the engine. These parameters may all be determined during the design of the retarder except for the engine speed which is a variable. However, the engine speed may be sensed with conventional speed sensors, and a signal proportional to engine speed can be inputted to the controller 40 via conduit 69. Thus, the controller 40 may be programmed to maximize the retarding horsepower. As will be pointed out in more detail below, since the actuator piston 28 directly contacts the exhaust valve assembly, the balance of the exhaust valve train, e.g., the pushtubes, cannot be damaged. Similarly, since the operating pressure is regulated, excess hydraulic pressures are not generated.

Figure 2A:
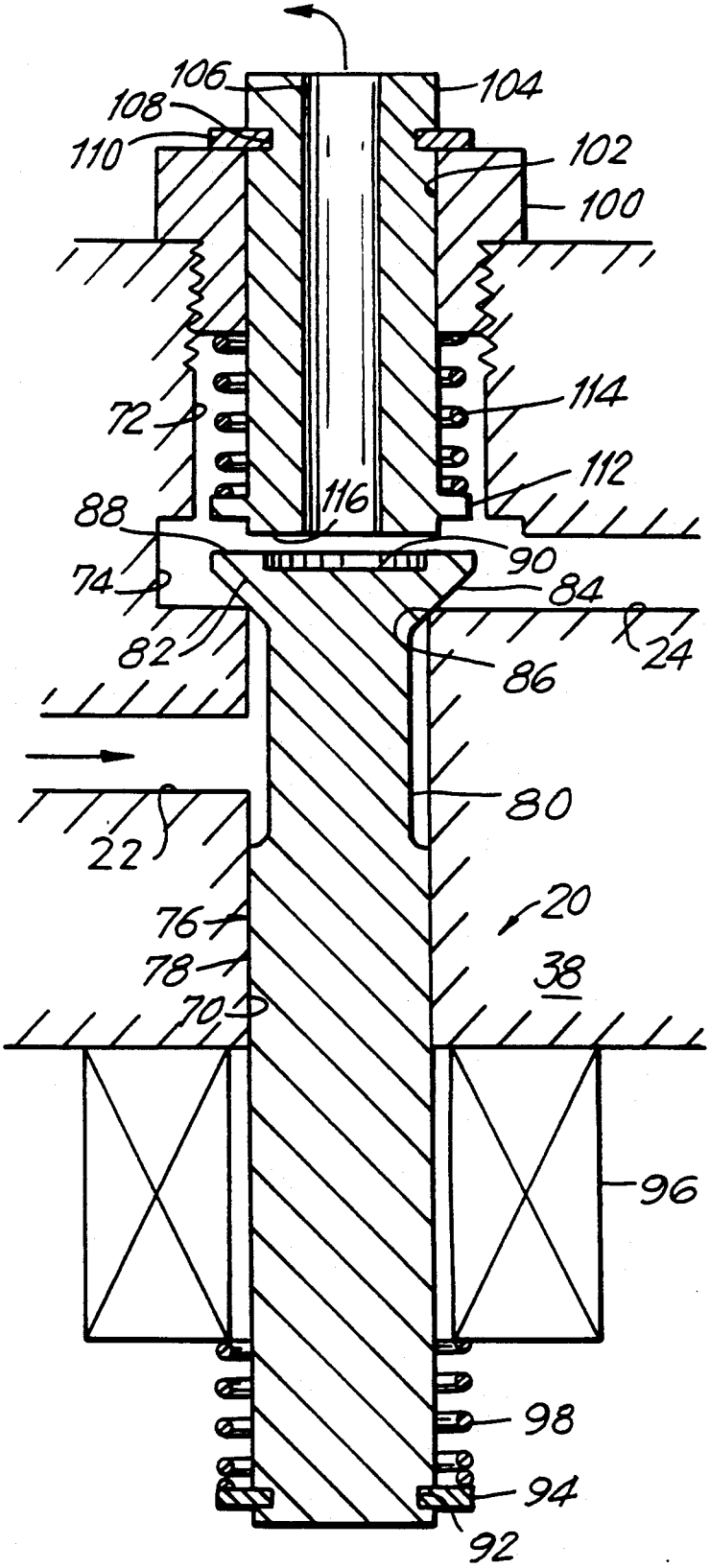
FIG. 2A is a schematic diagram of a solenoid operated servo valve for use in the present invention showing the servo valve in the closed position.
Figure 2B:
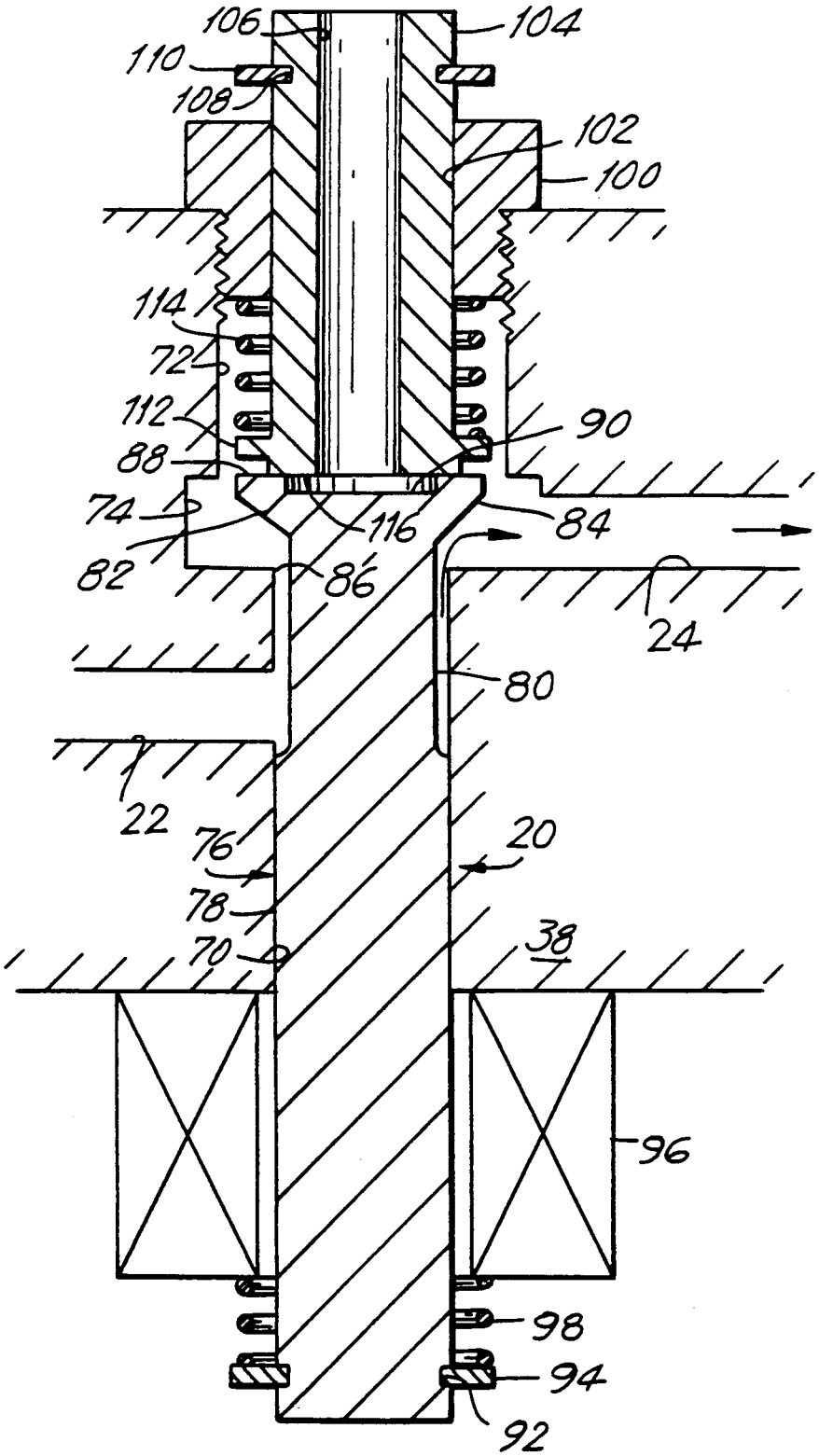
FIG. 2B shows the servo valve of FIG. 2A in the open position.

Reference is now made to FIGS. 2A and 2B which show the solenoid operated servo valve 20 in greater detail. In FIG. 2A the servo valve 20 is in its closed position while in FIG. 2B the valve is shown in its actuated or open position. A servo valve bore 70 is formed through the retarder housing 38. Coaxial with the servo valve bore 70 is a larger diameter drain valve bore 72 which is threaded at its upper end (as shown in FIGS. 2A and 2B). Duct 22 which communicates at one end with the high pressure plenum 18 communicates at its other end with the servo valve bore 70. An enlarged valve chamber 74 is formed at the juncture of the servo valve bore 70 and the drain valve bore 72. Duct 24 communicates between valve chamber 74 of the servo valve 20 and the actuator 26.

Spool valve 76 is provided with a shank portion 78 which is lap fitted into the valve bore 70 to inhibit leakage. Shank portion 78 extends below the retarder housing 38 (as viewed in FIGS. 2A and 2B). Near its upper end, the spool valve 76 has formed therein a neck section 80 of reduced diameter. When the spool valve 76 is in its closed position as shown in FIG. 2A the neck section 80 registers with duct 22. However, when the spool valve 76 is in its open position as shown in FIG. 2B, the neck section 80 is in registry with both duct 22 and duct 24 to provide a flow passageway therebetween. A poppet or mushroom head 82 is formed at the top end of the spool valve 76. A valve face 84 is formed on the underside of the poppet head 82. The valve face 84 seats against a valve seat 86 formed at the juncture of the servo valve bore 70 and the valve chamber 74. An annular valve face 88 is formed on the top surface of the poppet head 82 and defined by a blind bore 90 also formed in the poppet head 82.

The lower end of the shank portion 78 of the spool valve 76 is provided with a circumferential groove 92 into which a snap ring 94 is seated. A toroidal solenoid coil 96 is affixed to the retarder housing 38 coaxial with the shank portion 78 of the spool valve 76. A return spring 98 seated between the snap ring 94 and the solenoid coil 96 (or the retarder housing 38) biases the spool valve 76 to its closed or "down" position as shown in FIG. 2A where the valve face 84 is sealed against the valve seat 86. The solenoid coil 96 is a high frequency coil of known design capable of opening the spool valve 76 as rapidly as about 17 to 18 times per second on a continuous basis.

The drain valve bore 72 is closed by a threaded plug 100 having formed therethrough a bore 102. A drain valve 104 is lap fitted into the plug 100. The drain valve 104 has an axial bore 106 formed therethrough and circumferential groove 108 formed near its upper end to receive a snap ring 110. A circumferential rib 112 is formed near the lower end of the drain valve 104 to provide a seat for a return spring 114 which biases the drain valve 104 in a downward direction (as shown in FIGS. 2A and 2B) until the snap ring 110 seats against the upper surface of the plug 100. A valve face 116 is formed on the lower end of the drain valve 104.

As shown in FIG. 2A, when the spool valve 76 is in its closed position so that the valve face 84 is sealed against the valve seat 86 and the drain valve 104 is in its lowest position with the snap ring 110 seated against the plug 100, valve faces 88 and 116 are spaced apart so that duct 24 from the actuator 26 communicates to drain through the axial bore 106 of the drain valve 104. It will be observed that although the pressure in the high pressure duct 22 may be on the order of 3000 psi, the only force acting on the spool valve 76 is the relatively small axial force from the return spring 98 which biases the spool valve 76 to its closed position. Since the spool valve 76 is essentially balanced the solenoid 96 need only overcome the force of spring 98 to open the spool valve 76. It will also be observed that very little travel is required to cause valve face 88 on the spool valve 76 to contact valve face 116 on the drain valve 104 thereby sealing the axial bore 106 from the high pressure hydraulic fluid. This permits the use of a high frequency low force solenoid that can cycle rapidly on a continuous basis.

It will be appreciated that, in the open position, the forces on the spool valve 76 can also be controlled so as to provide adequate sealing between the spool valve 76 and the drain valve 104 while permitting rapid closing of the spool valve. It will be seen that the sealing force between the drain valve 104 and the spool valve 76 is the difference between the forces of the return springs 114 and 98 plus the force due to the high pressure hydraulic fluid. This latter force is a function of the outer diameter of the face 116 of the drain valve 104, the diameter of the bore 70 and the pressure of the hydraulic fluid.

Figure 3A:
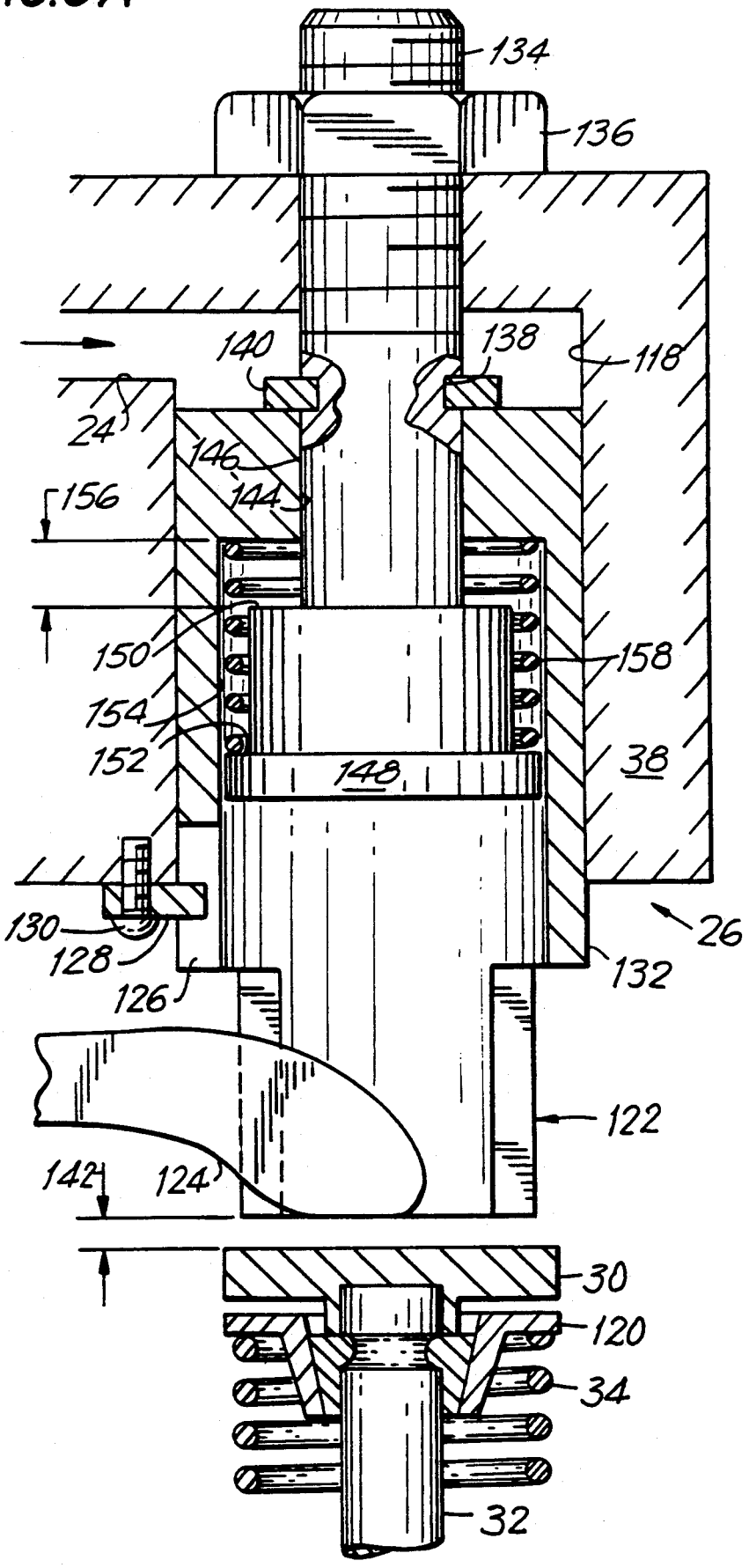
FIG. 3A is a schematic diagram of an exhaust valve actuator for use in the present invention.

Reference is now made to FIG. 3A which illustrates the exhaust valve actuator 26 in more detail. As noted above, the exhaust valve actuator 26 is mounted in the retarder housing 38 coaxially with the exhaust valve stem 32. It will be understood that if the engine should be provided with dual exhaust valves, the actuator would be positioned appropriately with respect to the exhaust valve crosshead or one of the exhaust valves as explained more fully in the prior art patents referred to hereinbefore. The exhaust valve actuator 26 comprises an actuator bore 118 which communicates at its upper end with the duct 24 and, as shown in FIG. 3A, is coaxial with the exhaust valve stem 32. The exhaust valve stem 32 carries a spring retainer ring 120 against which the valve spring 34 is seated to bias the exhaust valve to the closed position. A contact plate 30 is affixed to the end of the valve stem 32 so as to permit either the actuator 122 or the exhaust valve rocker arm 124 to drive the exhaust valve stem 32. The piston portion 132 of the actuator 122 is mounted for reciprocating motion within the actuator bore 118. It will be understood that the end of the actuator 122 (in particular the lower portion of piston 132) which contacts the contact plate 30 is split or slotted so as to accommodate the rocker arm 124. Accordingly, the piston portion 132 of the actuator 122 is also provided with a longitudinal groove 126 which registers with an anti-rotation lug 128 affixed to the retarder housing 38 by a machine screw 130. The piston portion 132 of the actuator 122 is preferably lap fitted into the bore 118 to inhibit leakage of high pressure hydraulic fluid.

An adjustable stop 134 is threaded into the retarder housing 38 and locked into its adjusted position by a locknut 136. The adjustable stop 134 is located coaxially with the actuator bore 118 and is provided with a circumferential groove 138 in its central region which carries a snap ring 140. The snap ring 140 forms an upper stop for the piston portion 132 of the actuator 122. The position of the snap ring 140 is adjusted so as to produce the desired clearance 142 between the rest position of the actuator 122 and the contact plate 30. This clearance is typically on the order of 0.018".

The piston portion 132 of the actuator 122 includes an axial bore 144 which mates with the shaft portion 146 of the adjustable stop 134. Preferably the bore 144 and the shaft 146 are lap fitted to inhibit leakage of high pressure hydraulic fluid. The adjustable stop 134 is provided with an enlarged head section 148 which includes a stop 150 and a seat 152. The head section 148 of the adjustable stop 134 is located within a bore 154 formed in the piston portion 132 of the actuator 122. The axial distance 156 between the stop 150 and the blind end of the bore 154 defines the travel of the actuator 122 between its rest position and its actuated position. A return spring 158 located between the blind end of the bore 154 and the seat 152 biases the actuator toward its rest position against the snap ring 140. It will be apparent that the valve opening produced by the actuator 122 will be equal to the axial distance 156 less the clearance 142. It will also be apparent that the clearance 142 will vary somewhat with the engine temperature which may cause axial expansion of the valve stem 32.

Figure 3B:
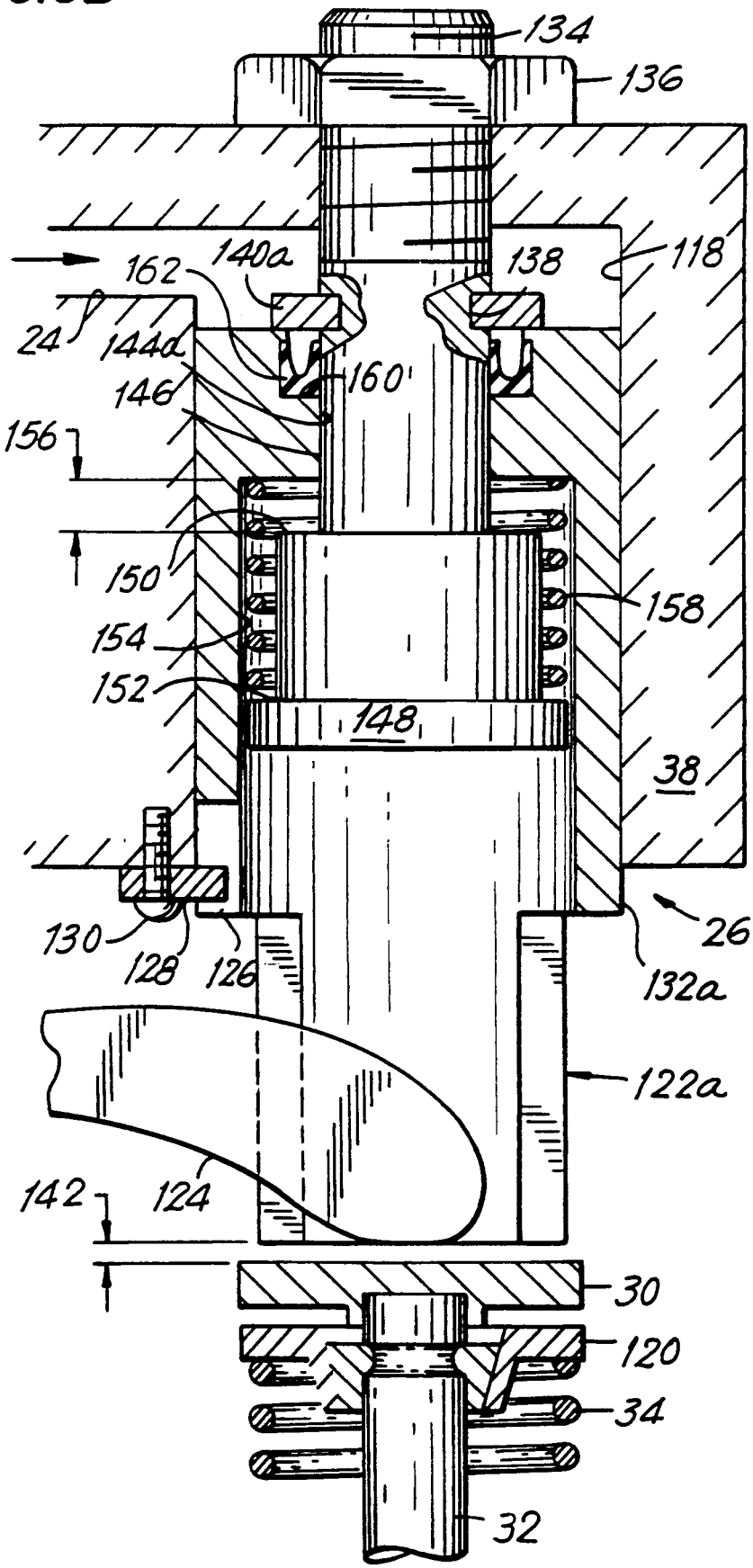
FIG. 3B is a schematic diagram of an alternative form of an exhaust valve actuator for use in the present invention.

It may be difficult to maintain, on a production basis, the required concentricity of the actuator bore 118, the axial bore 144 and the axis of the adjustable stop 134. In this event, the piston 132*a* of the actuator 122*a* may be modified as shown in FIG. 3B. Parts common to FIGS. 3A and 3B bear the same designators and the description thereof will not be repeated. As shown in FIG. 3B, the bore 144*a* is enlarged with respect to the shaft portion 146 of the adjustable stop 134 so as to provide clearance therebetween. A channel 160 is formed at the top of the bore 144*a* which functions as a seat for a high pressure seal 162. The snap ring 140*a* is provided with a larger outer diameter so that it extends beyond the outer diameter of the channel 160. It will be understood that the high pressure seal 162 will inhibit leakage of high pressure hydraulic fluid between the piston portion 132*a* of the actuator 122*a* and the shaft portion 146 of the adjustable stop 134 without requiring a close tolerance fit between those parts, thereby decreasing the manufacturing costs.

Figure 3C:
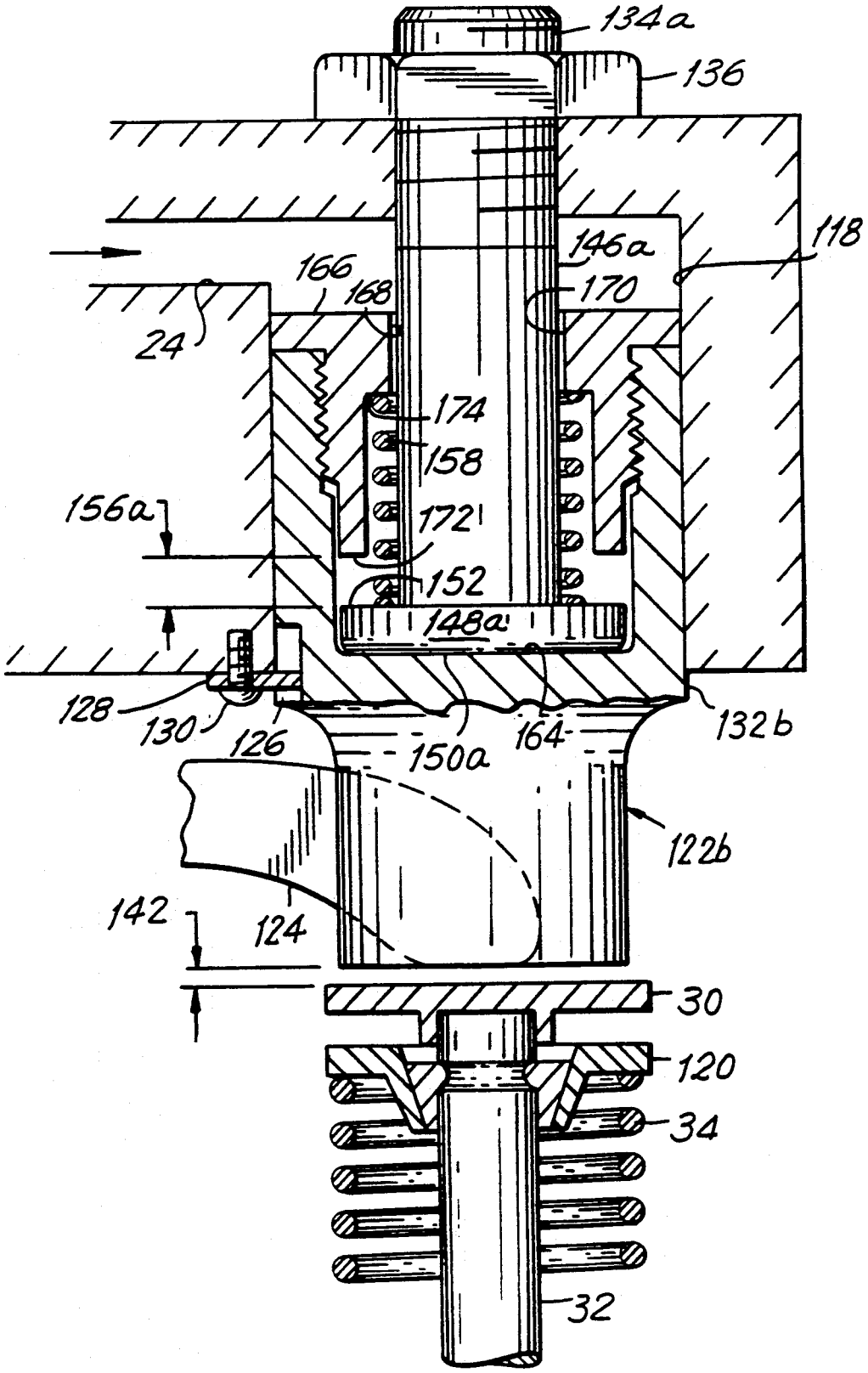
FIG. 3C is a schematic diagram of a second alternative form of an exhaust valve actuator for use in the present invention.

A still further modification of the actuator is shown in FIG. 3C where parts common to FIGS. 3A and 3C bear the same designation, the description of which will not be repeated. The actuator 122*b* is modified in that the piston portion 132*b* is closed at the bottom (as viewed in FIG. 3B) and open at the top so that the only leakage path is between the lateral surface of the piston portion 132*b* and the bore 118. The adjustable stop 134*a* is modified so that its shaft portion 146*a* extends to the head portion 148*a*. The face 150*a* of the head portion functions as a stop, acting against the inner end surface 164 of the piston portion 132*b* of the actuator 122*b*. A plug 166 having an axial bore 168 is threaded into the open end of the piston portion 132*b* of the actuator 122*b*. One or more axial grooves 170 are formed in the bore 168 to facilitate the flow of hydraulic fluid into and out of the piston portion 132*b* of the actuator 122*b*. A stop face 172 is machined on the lower end of the plug 166. The axial distance 156*a* between the stop face 172 and the seat 152 defines the travel of the actuator 122*b*. The return spring 158 is mounted between the seat 152 on the adjustable stop 134*a* and a seat 174 formed in the plug 166. It will be appreciated that the actuator shown in FIG. 3B requires only one close tolerance in order to inhibit leakage and that the concentricity of the adjustable stop 134*a*, plug 166 and bore 118 are not critical.

Figure 4:
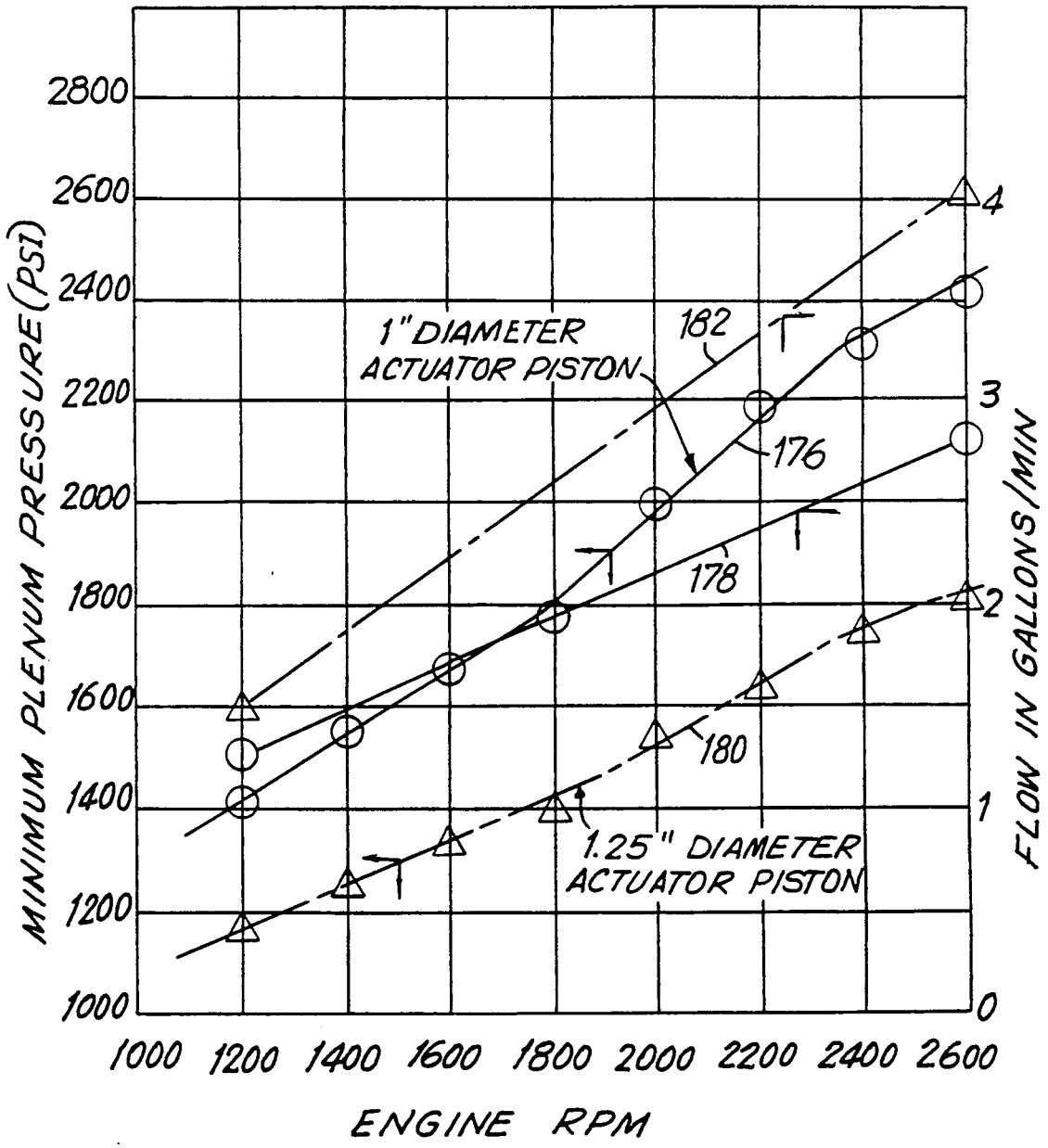
FIG. 4 is a graph plotting hydraulic fluid pressure and flow at various engine speeds for actuator pistons having 1.0" and 1.25" diameters.

Reference is now made to FIG. 4 which is a plot of hydraulic fluid flow against engine speed and minimum required fluid pressure against engine speed for a typical high pressure fluid pump capable of producing a nominal regulated pressure of about 3000 psi. In FIG. 4, the maximum engine speed is 2600 RPM as compared with the usual 2100 RPM for 14 liter engines since the new engines equipped with high pressure oil supply systems are typically smaller in displacement, e.g., 7.5 liters, and operate at higher speeds to attain the desired power rating. Curve 176 shows the minimum pressure required to drive an actuator having a 1.0" diameter piston so as to open the exhaust valve over the operating speed range of the engine. Curve 178 shows the pump flow required to sustain this operation. Curve 180 demonstrates that the pressure requirement is lower when a larger diameter actuator piston is employed, in this case a piston having a diameter of 1.25". However, as shown by curve 182, a greater flow requirement is associated with the larger actuator piston. It will be appreciated that, as with all compression release engine retarders, the retarding horsepower will be increased if the exhaust valve can be opened more rapidly. Ideally, the exhaust valve should be opened and closed instantaneously, but while this ideal can be approached, it cannot be attained. In the present case, the hydraulic pressure is the driving force and the greater the pressure the more rapid will be the valve motion. Since the regulated pressure of the pump is substantially constant, it follows that at lower engine speeds, the valve motion may be made somewhat more rapid than at higher engine speeds. This effect produces an increase in the retarding horsepower at lower engine speeds while the effect is less pronounced at higher engine speeds. Thus, with the compression release retarder of the present invention, the retarding horsepower curve over the operating speed range of the engine will be somewhat flatter than with the prior art compression release retarders.

FIG. 4 shows that the effect of higher driving pressure levels (over the minimum required level) is greater for larger diameter actuator pistons and thus such design is preferred if the pump capacity is sufficiently large. However, this is only one design consideration. Accordingly, the 1.0" and 1.25" diameter actuator pistons shown in FIG. 4 are to be regarded as exemplary only.

As pointed out above with respect to the prior art compression release retarders, the timing of the compression release event for optimum retarding horsepower is a function of engine speed. In accordance with the present invention the time required to open the exhaust valve is also a function of engine speed. Thus, the electronic controller 40 may be provided with an input through conduit 69 representing engine speed which takes account of both of these engine speed factors and the timing programmed to optimize the retarding horsepower over the entire operating speed range of the engine.

In operation it will be understood that when the electronic controller 40 energizes the solenoid coil 96 the servo valve 20 rapidly delivers hydraulic fluid at the regulated pressure to the actuator 26 and drives the actuator piston against a stop. When the signal from the controller is terminated, the servo valve 20 is opened to drain and the actuator 26 is rapidly returned to its rest position. During each cycle, the hydraulic fluid is dumped so that positive motion of the actuator occurs. Since the motion of the actuator between its "rest" and "actuated" positions is positively controlled and limited, the problem of "jacking" is avoided and the exhaust valve cannot be opened in excess of the designed amount, thereby insuring that the exhaust valves will not strike the engine piston. Similarly, since the retarder mechanism acts directly on the exhaust valve stem, no other parts of the valve train are subjected to loading by the retarder and cannot be damaged. Finally, when the retarder is turned off the actuator is disengaged from the exhaust valve and all other operating parts of the engine.

A principal purpose of the high pressure oil supply in engines of the type here involved is to drive the fuel injection system. This system, of course, is not used during the retarding mode of operation and therefore the pump capacity required for the fuel injectors is available for use by the retarder when the engine is in the retarding mode. As explained above, the retarder in accordance with the present invention can be designed to accommodate the capacity of the high pressure oil system so that no modifications or alterations of the high pressure oil system are required. In some cases it may be possible to employ high frequency solenoids for the retarder which are similar or identical to those used in the fuel injector system and thereby simplify the engine maintenance program.

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. An engine retarding system of a gas compression release type comprising a multi-cylinder four cycle internal combustion engine having a crankshaft, engine piston means associated with said crankshaft, exhaust valve means associated with each cylinder of said engine, high pressure hydraulic fluid supply means driven by said engine, retarder housing means, hydraulically driven actuator means movable between first and second positions in said retarder housing means and associated with said exhaust valve means to open said exhaust valve means, said actuator means being movable between a first position out of contact with said exhaust valve means and a second position opening said exhaust valve means, electronic controller means affixed to said engine and programmed to deliver a signal in response to the speed and position of said crankshaft, and solenoid actuated servo valve means having a drain outlet and positioned in said retarder housing means between said high pressure hydraulic fluid supply means and said actuator means, said servo valve means movable by said solenoid between a closed position wherein said servo valve means communicates between said actuator means and said drain outlet and an open position wherein said servo valve means communicates between said actuator means and said high pressure hydraulic fluid supply means.

2. An engine retarding system as set forth in claim 1 in which said solenoid is a high frequency solenoid.

3. An engine retarding system as set forth in claim 1 in which said servo valve means comprises a substantially balanced poppet valve mounted for reciprocating motion in said retarder housing and a drain valve mounted for reciprocating motion in said retarder housing and axially aligned with said poppet valve, first spring means biasing said poppet valve toward the closed position and second spring means biasing said drain valve toward said poppet valve.

4. An engine retarding system as set forth in claim 2 in which said servo valve means comprises a substantially balanced poppet valve mounted for reciprocating motion in said retarder housing and a drain valve mounted for reciprocating motion in said retarder housing and axially aligned with said poppet valve, first spring means biasing said poppet valve toward the closed position and second spring means biasing said drain valve toward said poppet valve.

5. An engine retarding system as set forth in claim 1 in which said actuator means comprises a piston means mounted for reciprocating motion in said retarder housing, said piston means including an actuator to act on said exhaust valve means and having an axial bore formed therethrough, an adjustable stop threaded into said retarder housing substantially coaxially with said piston means and passing through said axial bore, said adjustable stop having first and second stops to determine said first and second positions of said actuator and spring means located between said actuator and said adjustable stop biasing said actuator toward said first position.

6. An engine retarding system as set forth in claim 5 and comprising, in addition, an anti-rotation means comprising a lug mounted on said retarder housing and a groove formed on said piston means, said lug located in registry with said groove.

7. An engine retarding system as set forth in claim 5 in which said adjustable stop fits loosely in said axial bore of said piston means and comprising, in addition, a high pressure seal seated in said piston means and acting against said adjustable stop.

8. An engine retarding system as set forth in claim 7 and comprising, in addition, an antirotation means comprising a lug mounted on said retarder housing and a groove formed on said piston means, said lug located in registry with said groove.

9. An engine retarding system as set forth in claim 1 in which said exhaust valve actuator comprises a piston means mounted for reciprocating motion in said retarder housing, said piston means including an actuator to act on said exhaust valve means and having a blind bore formed in the end of said piston means opposite said actuator, said blind bore defining a stop to determine the said first position of said piston means, a plug threaded into said blind bore of said piston means, said plug defining a stop to determine said second position of said piston means and having an axial bore formed therethrough, an adjustable stop threaded into said retarder housing substantially coaxially with said piston means and passing through said axial bore of said plug, said adjustable stop having formed thereon an enlarged head positioned to act against the stops formed by said blind bore of said piston means and said plug, and spring means located between said plug and said adjustable stop biasing said piston means toward said first position.

10. An engine retarding system as set forth in claim 9 and comprising, in addition, an anti-rotation means comprising a lug mounted on said retarder housing and a groove formed on said piston means, said lug located in registry with said groove.

* * * * *